US008955344B2

(12) United States Patent
Kostelecky et al.

(10) Patent No.: US 8,955,344 B2
(45) Date of Patent: Feb. 17, 2015

(54) HVAC SENSOR ASSEMBLY AND METHOD

(75) Inventors: Milan Kostelecky, Brno (CZ); Cory Grabinger, Maple Grove, MN (US); William J. Bray, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 1247 days.

(21) Appl. No.: 12/691,090

(22) Filed: Jan. 21, 2010

(65) Prior Publication Data

US 2011/0174889 A1 Jul. 21, 2011

(51) Int. Cl.

| | |
|---|---|
| ***G01K 13/00*** | (2006.01) |
| ***F25B 49/00*** | (2006.01) |
| ***G01D 21/00*** | (2006.01) |
| ***G01K 9/00*** | (2006.01) |
| ***F24F 11/00*** | (2006.01) |
| *F24F 13/20* | (2006.01) |

(52) U.S. Cl.

CPC ..... *F24F 11/001* (2013.01); *F24F 13/20* (2013.01)

USPC ..... 62/129; 62/125; 73/866.5; 374/208

(58) Field of Classification Search

USPC ..... 62/125, 129, 131; 73/866.5; 374/208; 274/208

See application file for complete search history.

(56) References Cited

U.S. PATENT DOCUMENTS

| | | | | |
|---|---|---|---|---|
| 6,629,886 | B1 | 10/2003 | Estepp | |
| 6,938,506 | B2 * | 9/2005 | Henry et al. | 73/866.5 |
| 7,421,911 | B2 | 9/2008 | Desrochers et al. | |
| 7,465,086 | B1 * | 12/2008 | Foreman, Jr. | 374/143 |
| 7,478,761 | B2 | 1/2009 | Karamanos et al. | |
| 7,658,096 | B2 | 2/2010 | Pinto et al. | |
| 2008/0138241 | A1 | 6/2008 | Naarup | |
| 2009/0064803 | A1 * | 3/2009 | Pettit et al. | 73/866.5 |
| 2010/0224015 | A1 * | 9/2010 | Paxton et al. | 73/866.5 |

FOREIGN PATENT DOCUMENTS

GB 2324378 10/1998

OTHER PUBLICATIONS

"DTS Duct Temperature Sensor," 2 pages, prior to Jan. 21, 2010.

Honeywell, "H7015B Humidity/Temperature Duct Sensor," Product Data, 4 pages, 2001.

http://www.pentronic.se/Products/Temperaturesensors/Airtemperature/tabid/ . . . , "Air Temperature," 2 pages, printed Jun. 25, 2010.

http://www.smarthomeusa.com/ShopByManufacturer/Aprilaire/Item/8052/manual/, "Aprilaire Duct Mount/Outdoor Temperature Sensor—8052," 2 pages, printed Jun. 25, 2010.

(Continued)

*Primary Examiner* — Alexandra Elve

*Assistant Examiner* — Daniel C Comings

(74) *Attorney, Agent, or Firm* — Seager Tufte & Wickhem LLC.

(57) ABSTRACT

An HVAC sensor assembly for sensor deployment within an HVAC air passage defined by passage walls is provided. In some instances, the HVAC sensor assembly includes a base mountable to a passage wall of an HVAC air passage, and a support member attached to and extending out from the base and configured to project into the HVAC air passage. The HVAC sensor assembly may include one or more HVAC sensors secured to the support member such that the one or more HVAC sensors are positionable and then maintainable at a field configurable distance from the base.

23 Claims, 7 Drawing Sheets

(56) References Cited

OTHER PUBLICATIONS http://www.southsidecontrol.com/acatalog/Products_Sensors_3829.html, "South Side Control Supply Co. Sensors," 2 pages, printed Jun. 25, 2010.
Johnson Controls, "Remote Indoor, Outdoor, and Duct Mount Temperature Sensors," Product Bulletin, 3 pages, Feb. 10, 2005.
Johnson Controls, "TE-6300M Series Duct Probe Temperature Sensors," Installation Instructions, Part No. 24-4034-166, Rev. C, 2 pages, Issued Apr. 6, 2010.
MacMac Systems, "Duct Temperature Sensors Model TE-701/702," 6 pages, 2007.
Onset Computer Corporation, "Vaisala Duct Mount Humidity/Temperature Transmitter Connection Instructions for Use with HOBO H22 and U30 Series Data Loggers," 2 pages, prior to Jan. 21, 2010.
Phoenix Controls, "PTS102 Temperature Sensor," 3 pages, Revised Feb. 2010.
Regin, "TG-KH/PT . . . Duct Sensors," 2 pages, Revised Jun. 2009.
Siemens, "1773 Duct Temperature Sensors QAMI," 4 pages, Mar. 28, 2002.
Trend, "TB/TC, /TI, TO Thermistor Temperature Sensors," Data Sheet TA 200724 Issue 1/E, 4 pages, Jun. 25, 2007.

* cited by examiner

HVAC SENSOR ASSEMBLY AND METHOD

TECHNICAL FIELD

The disclosure relates generally to Heating, Ventilation, and Air Conditioning (HVAC) systems for conditioning the air of an inside space of a building or other structure, and more particularly, to sensors for such HVAC systems.

BACKGROUND

Most modern buildings use some sort of an HVAC system to control certain environmental conditions inside of the building. Such HVAC systems are typically configured to control a number of different environmental conditions including, for example, temperature, humidity, air quality and/or other environmental conditions, as desired. Such HVAC systems often include one or more sensors deployed within certain air passages (e.g. ducts, plenum, etc.) of the HVAC system in order to monitor certain air parameters within the system, such as dry bulb temperature, relative humidity, dew point temperature, enthalpy, carbon dioxide, carbon monoxide, ozone, air contaminants, and/or other air parameters, as desired. Accommodating the many types of sensors as well as the wide variety of HVAC system configurations and/or equipment can present a challenge.

SUMMARY

The disclosure relates generally to HVAC systems for conditioning the air of an inside space of a building or other structure, and more particularly, to sensors for such HVAC systems. In some instances, the disclosure relates to an improved and more versatile HVAC sensor assembly that can more easily accommodate different types of sensors and/or different types of HVAC system configurations and/or equipment.

In an illustrative but non-limiting example, the disclosure provides an HVAC sensor assembly for sensor deployment within an HVAC air passage defined by passage walls. The HVAC sensor assembly may include a base mountable to a passage wall of the HVAC air passage, and a support member attached to and extending out from the base and configured to project into the HVAC air passage. The HVAC sensor assembly may includes one or more HVAC sensors secured to the support member such that the one or more HVAC sensors are positionable and then maintainable at a field configurable distance from the base, and thus at a desired position within the HVAC air passage.

The above summary is not intended to describe each and every disclosed illustrative example or every implementation of the disclosure. The Description that follows more particularly exemplifies various illustrative embodiments.

BRIEF DESCRIPTION OF THE FIGURES

The following description should be read with reference to the drawings. The drawings, which are not necessarily to scale, depict selected illustrative embodiments and are not intended to limit the scope of the disclosure. The disclosure may be more completely understood in consideration of the following description of various illustrative embodiments in connection with the accompanying drawings, in which.

DESCRIPTION

The following description should be read with reference to the drawings, in which like elements in different drawings are numbered in like fashion. The drawings, which are not necessarily to scale, depict selected illustrative embodiments and are not intended to limit the scope of the invention. Although examples of construction, dimensions, and materials are illustrated for the various elements, those skilled in the art will recognize that many of the examples provided have suitable alternatives that may be utilized.

Figure 1:
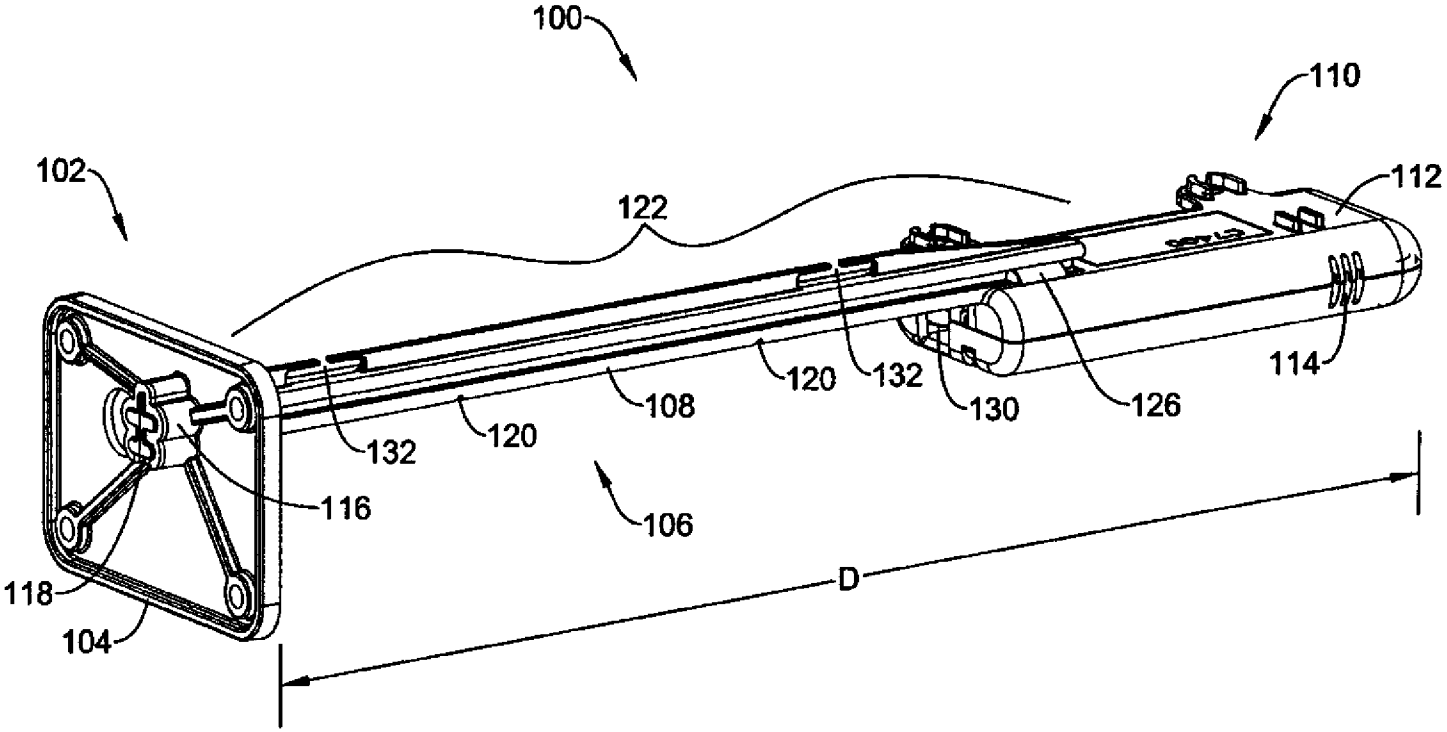
FIG. 1 is a schematic perspective view showing an illustrative HVAC sensor assembly.
Figure 2:
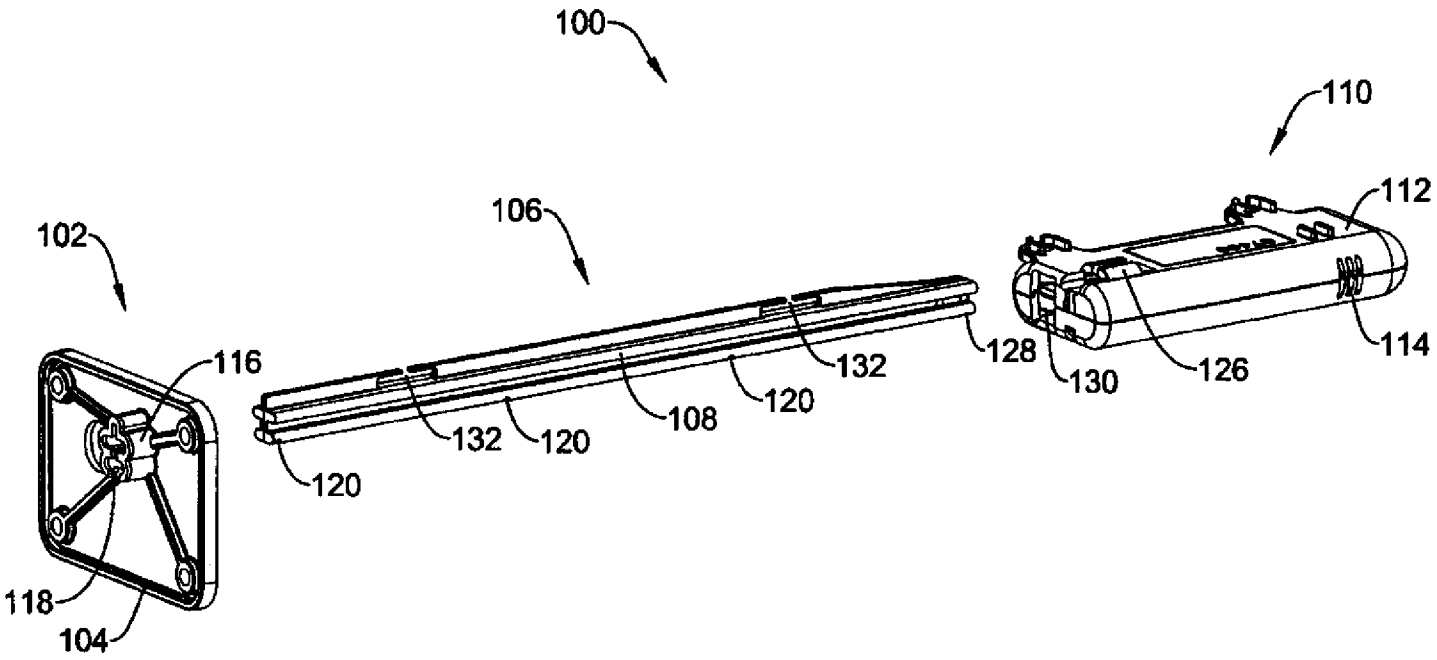
FIG. 2 is a schematic perspective view showing the illustrative HVAC sensor assembly of FIG. 1 in a partially disassembled state.

FIG. 1 is a schematic perspective view showing an illustrative HVAC sensor assembly 100 for deploying one or more HVAC sensors within an HVAC air passage. FIG. 2 is a schematic perspective view showing the illustrative HVAC sensor assembly 100 of FIG. 1 in a partially disassembled state. The HVAC air passage may be, for example, a duct, plenum, manifold, or any other suitable air passage defined by passage walls. In the illustrative embodiment, HVAC sensor assembly 100 may include a base 102, which may be or include a flange 104, mountable to a passage wall of an HVAC air passage. In some illustrative embodiments, the base 102 may take a form other than that of a flange. It is contemplated that base 102 may be mounted to a passage wall of an HVAC air passage in any suitable manner, such as by screws, bolts, rivets, adhesive, and/or any other suitable way.

The illustrative HVAC sensor assembly 100 also includes a support member 106, which may be a beam 108, attached or secured to the base 102 and extending out from the base 102, projecting into an HVAC air passage. The support member 106 may project in a substantially perpendicular direction from the passage wall to which the base 102 may be attached, but this is not required. In some illustrative embodiments, the support member 106 may take a different form other than that of a beam 108. One or more HVAC sensors (not visible in FIG. 1) may be secured to support member 106 in such a way that the sensors are positionable and maintainable at a field configurable sensing distance D (illustrated schematically) from the base 102. Structures and methods for achieving field configurability of the distance D between the base 102 and the HVAC sensors are discussed in further detail herein.

In HVAC sensor assembly 100, a platform 110 may be attachable to beam 108, and one or more HVAC sensors (not visible in FIG. 1) may be secured relative to the platform. In some illustrative embodiments, the platform 110 may be an enclosure 112, and HVAC sensors may be disposed inside the enclosure 112, and the enclosure may include openings 114 or any other suitable features such as vents, vias, ports, and/or the like that may assist the sensors in sampling the air in the HVAC air passage. Collectively, the platform 110 and HVAC sensors secured thereto may be considered an HVAC sensor package. The HVAC sensors may be any suitable sensor or sensors. For example, the HVAC sensors may include a dry bulb temperature sensor, a wet bulb temperature sensor, a relative humidity sensor, an enthalpy sensor, an anemometer, a chemical detector, and/or any other suitable sensor as desired. It is contemplated that any suitable sensor technology may be used. The HVAC sensors may directly measure air parameters or qualities of interest, or they may be used in combination with other sensors or information sources to provide desired information or parameters.

HVAC sensor assembly 100 may maintain the one or more HVAC sensors at a sensing position within an HVAC air passage at a field configurable sensing distance D from the base 102. In FIG. 1, sensing distance D is measured from base 102 to the actual position of the one or more HVAC sensors on platform 110, or it may be measured to a fiducial mark or any other suitable reference point of the platform and/or sensors.

In some embodiments, flange 104 may include an attachment mechanism 116 structured to releasably secure the beam 108 relative to the flange 104. As shown in FIG. 1, attachment mechanism 116 may have an opening complementary to a cross-sectional profile of beam 108, though other forms for attachment mechanisms are contemplated. In FIG. 1, the beam 108 may have an "I-beam" cross-section, at least in part. The beam 108 may be slidably secured relative to the flange 104 by the attachment mechanism 116. That is, during use in the field, an installer may slide the beam 108 relative to the opening in the flange 104 to establish, set and/or adjust the field configurable sensing distance D. In some instances, the attachment mechanism may allow the beam 108 to be positioning relative to the flange 104 without sliding, for example, by detaching the flange 104 from the beam 108 and reattaching it at a different position.

When desired, the attachment mechanism 116 of flange 104 may be structured with an engagement mechanism that serves to fix the position of the beam 108 relative to the flange 104. Such engagement may or may not be reversible. In some illustrative embodiments, a set screw may be provided as an engagement mechanism. In HVAC sensor assembly 100, attachment mechanism 116 may include an engagement tab 118 (more easily seen in FIG. 2), which may be spring-loaded, as an engagement mechanism. Engagement tab 118 may engage with one or more notches or teeth 120 of beam 108 to releasably secure the beam 108 relative to the flange 104. Notches 120 may be provided in any suitable number and in any suitable locations along beam 108. In some illustrative embodiments, an essentially continuous series of notches (or teeth) may be provided to form a gear rack or the like. In some cases, notches 120 may be provided in beam 108 at the time of manufacture, while in other cases, notches 120 may be formed in beam 108 after manufacture. In some illustrative embodiments, a notching tool may be provided for post-manufacture notch formation.

Figure 3:
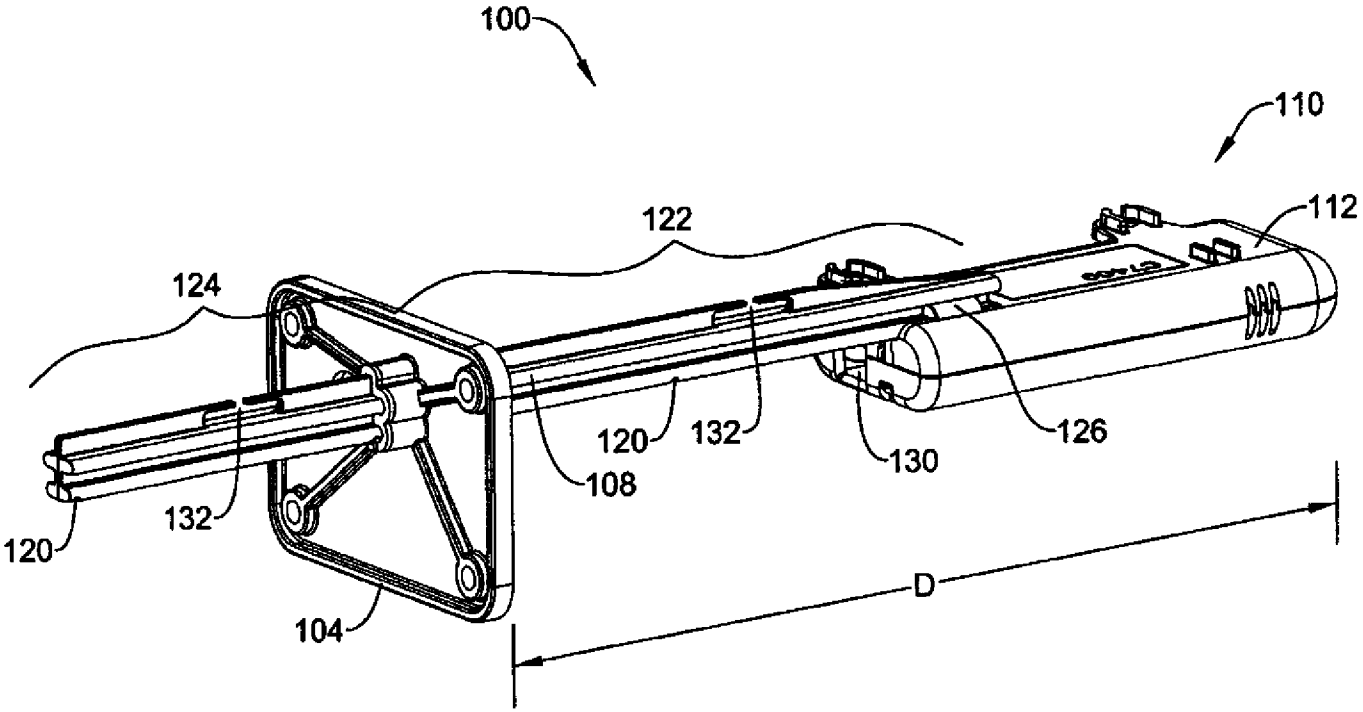
FIG. 3 is a schematic perspective view showing the illustrative HVAC sensor assembly of FIG. 1 in an alternate configuration.

Engagement tab 118 and notches 120 may be shaped (for example, with ramped surfaces) such that a force between the flange 104 and beam 108 directed along the longitudinal extent of the beam (i.e., along the long axis of the beam) may be sufficient to disengage the engagement tab 118 from a notch 120, after which the relative position of beam 108 and flange 104 may be slidably set and/or adjusted. In some illustrative embodiments, an engagement tab 118 may be structured to allow manual manipulation to effect release from a notch 120, for example, with a finger-operated lever. In FIG. 1, engagement tab 118 is engaged in a left-most (relative to the page) notch 120, which is not visible in FIG. 1, but may be seen in the partially disassembled view of FIG. 2. FIG. 3 is a schematic perspective view showing the illustrative HVAC sensor assembly 100 of FIG. 1 in an alternate configuration. In FIG. 3, the beam 108 is secured relative to the flange 104 with engagement tab 118 engaged in the second notch (counting from the left edge and not visible in FIG. 3, but visible in FIGS. 1 and 2).

In comparing the configurations of HVAC sensor assembly 100 in FIGS. 1 and 3, it is seen that field configurable sensing distance D is less in FIG. 3 than in FIG. 1. In both cases, a major portion 122 of the beam 108 is configured to extend into an HVAC air passage when the flange 104 is attached to a passage wall of the HVAC air passage. In FIG. 3, portion 124 may be considered an excess portion of beam 108, and optionally may be removed such as by cutting away.

It is contemplated that platform 110 may include at least one attachment mechanism 126 structured to adjustably secure the platform to the beam 108. The attachment mechanism 126 may include an engagement mechanism (not visible) that serves to fix the platform 110 relative to the beam 108. The engagement mechanism may be any suitable mechanism, such as a set screw or a spring-loaded engagement tab, similar to that described above. The engagement mechanism may engage with a notch 128 (visible in FIG. 2) disposed at the end of the beam 108 furthest from the flange 104. Notch 128 may be shaped differently than notches 120, or it may be shaped similarly. In some illustrative embodiments, a beam 108 may be shortened by cutting it adjacent a notch such that platform 110 may be adjustably secured to the beam at the newly cut end. Alternatively, a beam 108 may be cut and a notch formed in the beam after the cut is made. The engagement mechanism of the attachment feature 126 of the platform and the notch 128 and/or notches 120 may be structured to facilitate engagement and/or disengagement with longitudinal forces, similarly to how engagement tab 118 and notches 120 may be structured to engage and/or disengage.

In some cases, the platform 110 may include a connection port 130 with which wires, optical fibers, or any other suitable carriers for transmission of power and/or signals may be connected. When so provided, the support member 106 may include one or more wire retention features 132, such as fingers/slots, which may help obviate the need for non-integral wire management devices such as cable ties. In other cases, the platform 110 may be a wireless device that may wireless transmit and/or receive one or more signals, including power and/or data signals.

Figure 4:
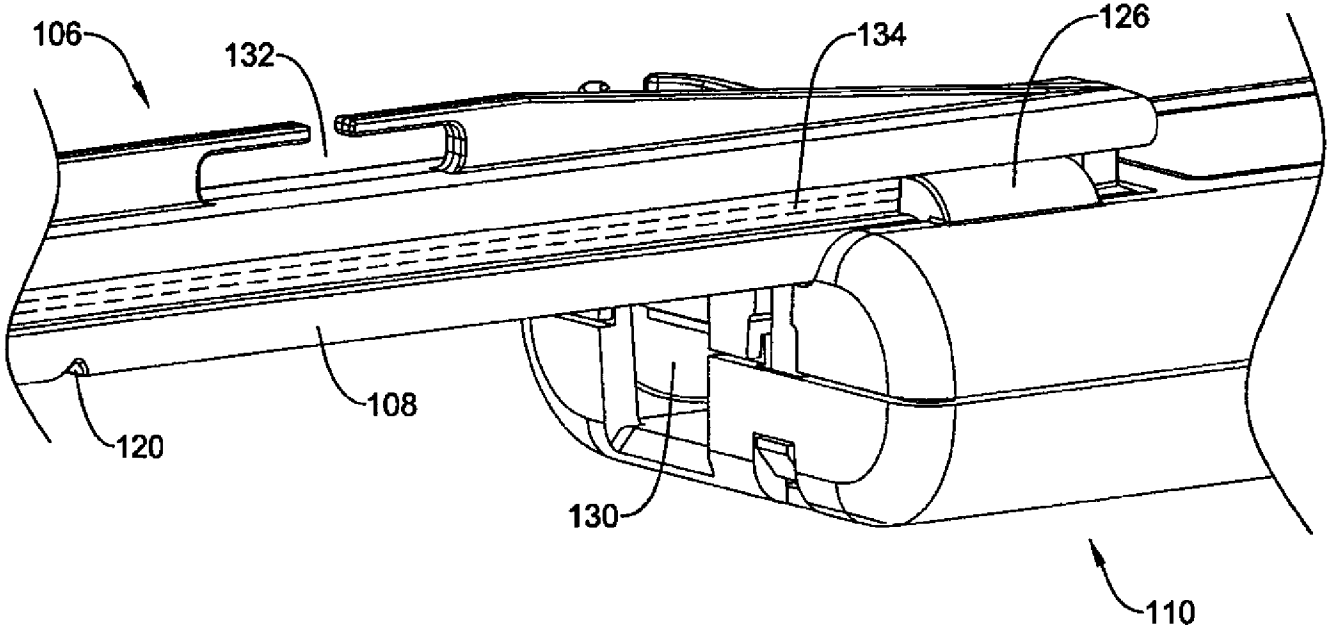
FIG. 4 is a schematic perspective close-up view showing the region where the support member and the platform of the illustrative HVAC sensor assembly of FIG. 1 connect.

FIG. 4 is a schematic perspective close-up view of the region where beam 108 and platform 110 connect, showing some features of HVAC sensor assembly 100 in greater detail. In some illustrative embodiments, the beam 108 may optionally include integral conductors 134 (shown in phantom representation) for transmitting power and/or signals along the beam. In such an embodiment, the platform 110 may include contacts structured to be in conductive communication with the conductors when the platform is secured to the beam. Such contacts may be included, for example, in attachment mechanism 126, or elsewhere as desired.

Platform 110 may include any suitable components for powering HVAC sensors secured relative to the platform and for processing and/or communicating information from the sensors. Platform 110 may receive power from one or more external sources, or it may carry on-board power. Communication from or to HVAC platform, for example with an HVAC controller, may be performed with wired, wireless, optical, or any other suitable technology and/or protocols. Base 102 may include, be attached to, or be part of an enclosure such as a junction box in communication with platform 110. An example of another illustrative HVAC sensor assembly including an enclosure attached to, including, or formed at least in part by a base, may been seen in FIG. 7 and is described elsewhere herein. Such an enclosure may house components for powering HVAC sensors secured relative to the platform 110 and for processing and/or communicating information from the sensors, and for communicating with, for example, an HVAC controller.

Figure 5:
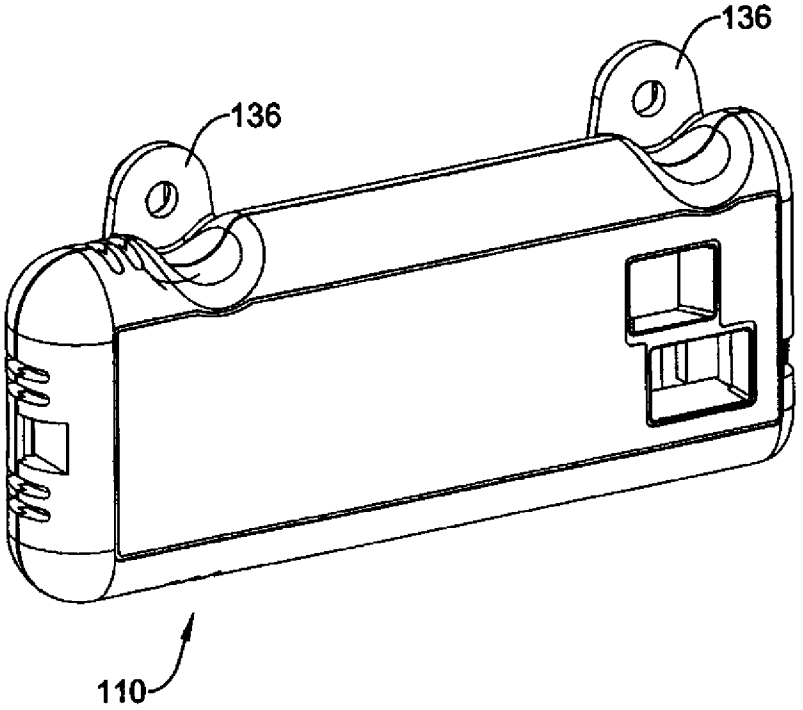
FIG. 5 is a schematic perspective view showing the platform of the HVAC sensor assembly of FIG. 1.

HVAC sensor assembly 100 may provide additional mounting options. FIG. 5 is a schematic perspective view of platform 110 of the HVAC sensor assembly 100 unattached to the support member 106. As can be seen, and in the illustrative embodiment, the platform 110 may include attachment structures 136 for attachment of the platform 110 directly to a passage wall of an HVAC air passage, without the base and/or the support member. These attachment structures 136 may include holes for receiving one or more mounting screws, bolts, or the like.

Figure 6:
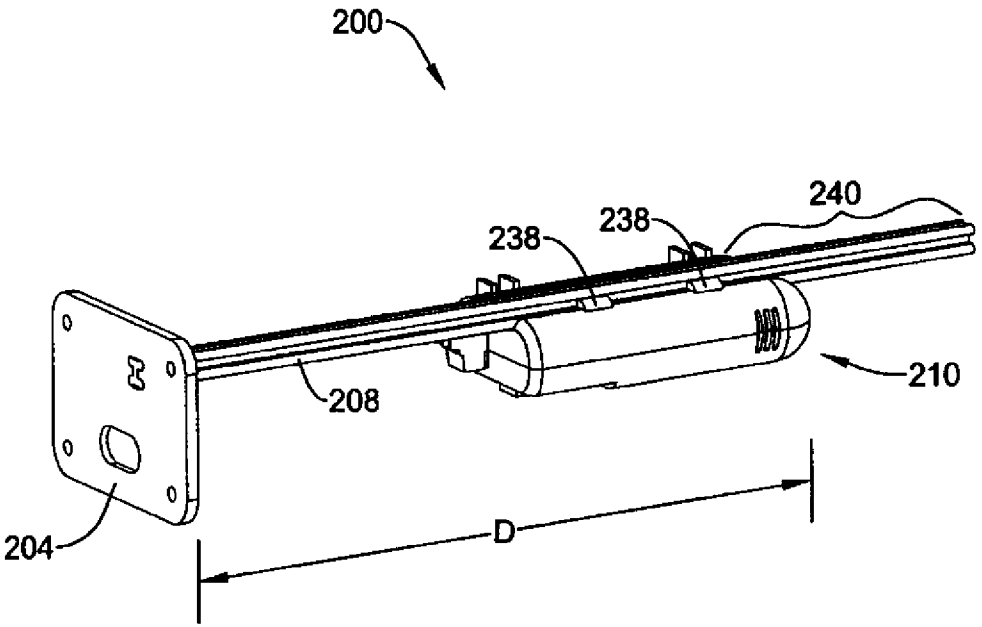
FIG. 6 is a schematic perspective view showing another illustrative HVAC sensor assembly.

FIG. 6 is a schematic perspective view showing another illustrative HVAC sensor assembly 200. HVAC sensor assembly 200 may include any compatible features of HVAC sensor assembly 100 of FIGS. 1-5. HVAC sensor assembly 200 may include a flange 204 mountable to a passage wall of an HVAC air passage, and a beam 208 attached or secured to the flange and extending out from it, projecting into the HVAC air passage. HVAC sensor assembly 200 includes a platform 210. One or more HVAC sensors (not visible in FIG. 6) may be secured relative to the platform 210. HVAC sensor assembly 200 may be field configured to maintain the one or more HVAC sensors at a sensing position within an HVAC air passage at a field configurable sensing distance D from the flange 204.

With HVAC sensor assembly 100 of FIGS. 1-5, the sensing distance D may be field configured in a number of ways including, but not limited to, adjusting the position of beam 108 relative to the flange 104, and/or cutting the beam and attaching the platform 110 to the (cut) end of the beam. HVAC sensor assembly 200 of FIG. 6 is structured to allow the sensing distance D to be field configured, set, adjusted, and/or established by repositioning the platform 210 along the longitudinal extent (i.e., along the long axis) of the beam 208. In various exemplary embodiments, it is contemplated that such repositioning may be performed with or without sliding of the platform 210 relative to the beam 208. Platform 210 may include at least one attachment mechanism 238 structured to adjustably secure the platform to the beam. Furthermore, the one or more attachment mechanisms 238 may be structured to allow slidable repositioning of the platform 210 along the longitudinal extent of the beam 208. At least one attachment mechanism 238 may include an engagement mechanism (not shown) for fixing a position of the platform relative to the longitudinal extent of the beam. Such an engagement mechanism may include, for example, a set screw or a spring-loaded engagement tab (not shown) structured to engage with one or more notches (not shown) of the beam 208. Any excess portion 240 of beam 208 may be removed, if desired.

HVAC sensor assembly 200 may also be structured to allow adjusting the position of beam 208 relative to the flange 204. Similar or different engagement mechanisms may be employed for engaging the flange 204 to the beam 208, and engaging the platform 210 to the beam. In some illustrative embodiments, the flange 204 and beam 208 may be essentially permanently affixed without adjustability.

A method for deploying one or more sensors within an HVAC air passage defined by passage walls is contemplated using devices such as HVAC sensor assemblies 100 and 200. The method may include attaching a flange to a passage wall of an HVAC air passage and attaching a beam to the flange such that a major portion of the beam extends into the HVAC air passage. The method further may include attaching a platform having one or more sensors to the major portion of the beam to deploy the one or more sensors at a field configurable sensing distance from the passage wall. Optionally, the method may include adjusting the platform to a platform attachment position along the major portion of the beam, such that the platform attachment position establishes, at least in part, the field configurable sensing distance. As an alternative or additional option, the method may include adjusting the position of the beam relative to the flange to establish a flange attachment position along the beam, and to establish a length of the major portion of the beam extending into the HVAC air passage, such that the length of the major portion of the beam establishes, at least in part, the field configurable sensing distance.

Figure 7:
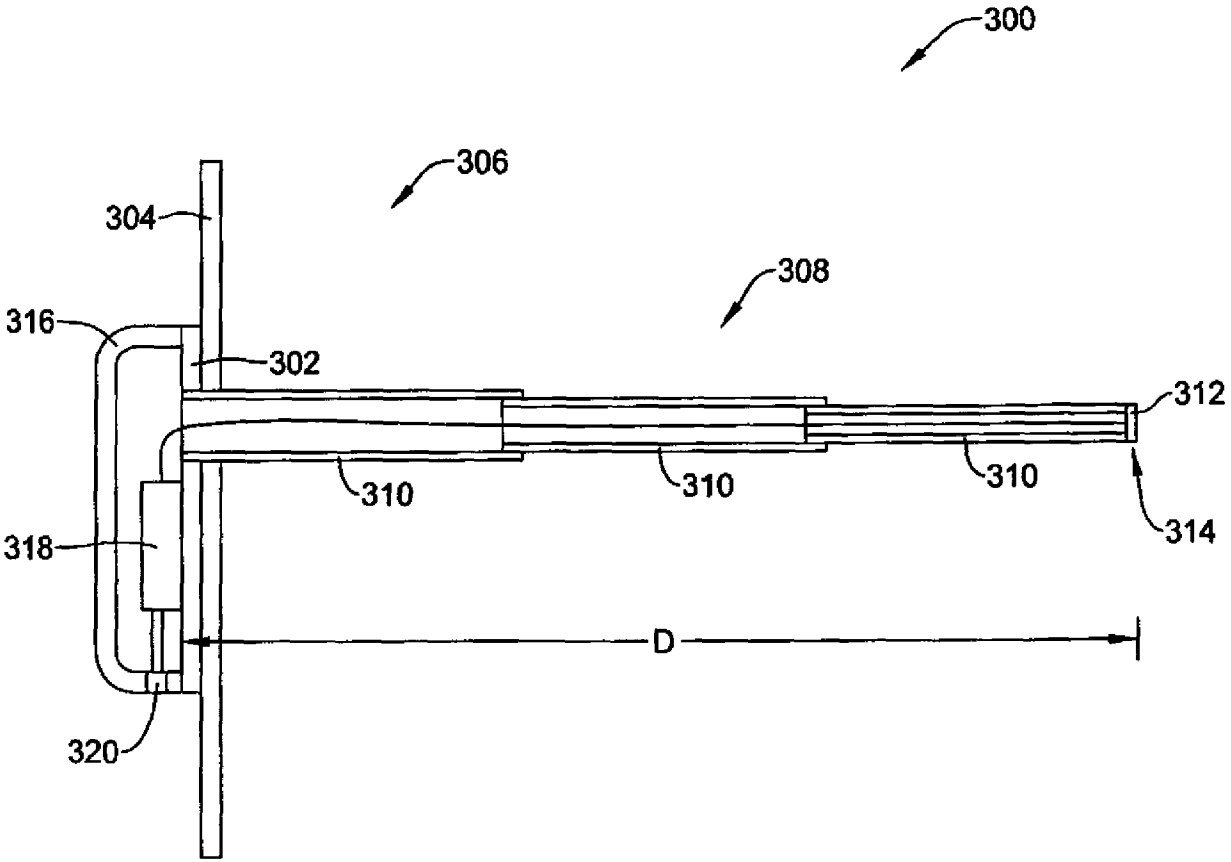
FIG. 7 is a schematic cross-sectional view showing another illustrative HVAC sensor assembly.

Additional configurations for HVAC sensor assemblies are contemplated. For example, FIG. 7 is a schematic cross-sectional view showing another illustrative HVAC sensor assembly 300. The assembly 300 may include a base 302 mountable to a passage wall 304 of an HVAC air passage 306 defined by passage walls, and a support member 308 attached to and extending out from the base, configured to project into the HVAC air passage. The support member 308 may include slidably nested hollow rods 310 with one or more HVAC sensors 312 disposed at a sensor end 314 of the support member. Support member 308 may be configured to extend away from the base 302 such that the HVAC sensors 312 are positionable and then maintainable at a field configurable distance D from the base by simply telescoping the slidably nested hollow rods 310 of the support member 08 to a desired position.

The base 302 may be attached to, or may form all or part of, an enclosure 316, which may be a junction box in some cases. Enclosure 316 may include components 318 associated with the HVAC sensors 312, such as electronic components for providing power to the sensors and/or processing signals from the sensors, as well as components for communicating data, for example, an HVAC controller. Such communication may be performed through any appropriate technology, including, for example, a wired or optical connection 320, radio-frequency communications, etc.

The disclosure should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

What is claimed is:

1. An HVAC sensor assembly for sensor deployment within an HVAC air passage defined by passage walls, the HVAC sensor assembly comprising:

a base mountable to a passage wall of the HVAC air passage, the base having an opening comprising a non-circular cross-sectional profile relative to the plane of the base with one or more projections partially defining the cross-section of the profile;

a support member attached to and extending out from the base, the support member configured to project into the HVAC air passage, the support member comprising a beam that has a cross-sectional profile that is keyed to the opening of the base such that the opening of the base only receives the cross-sectional profile of the beam at one or more predetermined rotational orientations of the beam relative to the base; and one or more HVAC sensors secured to the support member, wherein the one or more HVAC sensors are secured to the support member such that the one or more HVAC sensors are slidably positionable, without rotation about the support member, to a field configurable distance from the base, and then maintainable at the field configurable distance from the base.

2. The HVAC sensor assembly of claim 1, wherein the base includes a flange having the opening, with the beam of the support member passing through the opening in the flange and secured to the flange via an interference connection.

3. The HVAC sensor assembly of claim 2, wherein the flange includes an attachment mechanism defining at least part of the opening, the attachment mechanism structured to releasably secure the beam relative to the flange.

4. The HVAC sensor assembly of claim 2, wherein the beam is slidably secured relative to the flange such that, during use in the field, an installer can slide the beam relative to the flange to set and/or adjust the field configurable distance.

5. The HVAC sensor assembly of claim 2, further comprising a platform attachable to the beam, wherein the one or more HVAC sensors are secured relative to the platform and the platform is slidably repositionable along a longitudinal extent of the beam, without rotation about the beam.

6. The HVAC sensor assembly of claim 5, wherein the platform includes at least one attachment mechanism that is structured to adjustably secure the platform to the beam via an interference connection.

7. The HVAC sensor assembly of claim 6, wherein the at least one attachment mechanism of the platform includes an engagement mechanism for fixing a position of the platform relative to the longitudinal extent of the beam.

8. The HVAC sensor assembly of claim 5, wherein the beam includes one or more notches structured to engage with at least one of the flange and the platform.

9. The HVAC sensor assembly of claim 5, wherein the beam includes integral conductors for transmitting power and/or signals along the beam, and wherein the platform includes contacts structured to be in conductive communication with the integral conductors of the beam when the platform is secured to the beam.

10. The HVAC sensor assembly of claim 5, wherein the platform includes attachment structures configured to receive one or more threaded fasteners to attach the platform directly to a passage wall of the HVAC air passage when the platform is used without the base and/or the beam.

11. The HVAC sensor assembly of claim 1, wherein the support member includes one or more wire retention features.

12. The HVAC sensor assembly of claim 1, wherein the beam comprises an I-beam cross-sectional profile and the opening of the base comprises a cross-sectional profile that is complimentary to the I-beam cross-sectional profile of the beam.

13. The HVAC sensor assembly of claim 1, further comprising an enclosure attached to the base.

14. The HVAC sensor assembly of claim 1, wherein the base forms at least part of an enclosure.

15. An HVAC sensor assembly for sensor deployment within an HVAC air passage defined by passage walls, the HVAC sensor assembly being structured for field configuration of a sensing distance within the HVAC air passage, the HVAC sensor assembly comprising:

a flange mountable to an HVAC passage wall of the HVAC air passage, the flange having an opening that has a non-circular cross-sectional profile relative to the plane of the flange with one or more projections partially defining the cross-section of the profile;

a beam slidingly attached to the flange for projecting into the HVAC air passage, the beam having a cross-sectional profile that, when inserted into the opening in the flange, allows the beam to slide longitudinally relative to the flange but does not allow the beam to rotate substantially relative to the flange;

an HVAC sensor package attached to the beam, the HVAC sensor package including:

one or more HVAC sensors;

an enclosure housing the one or more HVAC sensors; and wherein the flange, the beam, and/or the HVAC sensor package are configured such that the HVAC sensor package is mountable at a field configurable sensing distance from the flange, without having to rotate the HVAC sensor package about the beam.

16. The HVAC sensor assembly of claim 15, wherein the enclosure is attachable to the beam at varying discrete positions along a length of the beam, whereby a discrete position of attachment of the enclosure along the length of the beam establishes, at least in part, the sensing distance.

17. The HVAC sensor assembly of claim 15, wherein the beam is attachable to the flange at varying positions along the beam, whereby a position of attachment of the beam to the flange establishes, at least in part, the sensing distance.

18. The HVAC sensor assembly of claim 15, wherein the beam is secured to the flange at a desired longitudinal position via an interference connection.

19. A method for deploying one or more sensors within an HVAC air passage defined by passage walls, the method comprising:

attaching a flange to a passage wall of the HVAC air passage, the flange defining an opening that has a non-circular cross-sectional profile relative to the plane of the flange with one or more projections partially defining the cross-section of the profile;

inserting a beam through the opening in the flange such that a portion of the beam extends into the HVAC air passage, the beam having a cross-sectional profile that, when inserted into the opening in the flange, allows the beam to slide longitudinally relative to the flange but does not allow the beam to rotate substantially relative to the flange, the beam having a platform with one or more sensors attached to the beam such that the platform is positioned in the HVAC air passageway;

longitudinally sliding the beam relative to the flange, without rotation, to position the platform relative to the flange in order to deploy the one or more sensors at a field configurable sensing distance from the passage wall.

20. The method of claim 19, further comprising the step of:

slidably adjusting, without rotation, the platform to a platform attachment position along the beam, wherein the platform attachment position establishes, at least in part, the field configurable sensing distance.

21. The method of claim 19, further comprising the step of: removing one or more excess portions of the beam.

22. The HVAC sensor assembly of claim 15, wherein the HVAC sensor package includes attachment structures configured to receive one or more threaded fasteners to secure the HVAC sensor package directly to the passage wall of the HVAC air passage when the HVAC sensor package is used without the flange and/or the beam.

23. The HVAC sensor assembly of claim 19, wherein the beam is secured to the flange at a desired longitudinal position via an interference connection.

* * * * *